US006818073B2

(12) United States Patent
Strezov et al.

(10) Patent No.: US 6,818,073 B2
(45) Date of Patent: Nov. 16, 2004

(54) METHOD OF PRODUCING STEEL STRIP

(75) Inventors: Lazar Strezov, Adamstown Heights (AU); Kannappar Mukunthan, Rankin Park (AU); Walter Blejde, Brownsburg, IN (US); Rama Mahapatra, Indianapolis, IN (US)

(73) Assignee: Nucor Corporation, Charlotte, NC (US)

( * ) Notice: Subject to any disclaimer, the term of this patent is extended or adjusted under 35 U.S.C. 154(b) by 22 days.

(21) Appl. No.: 10/422,217

(22) Filed: Apr. 24, 2003

(65) Prior Publication Data

US 2003/0205355 A1 Nov. 6, 2003

Related U.S. Application Data

(62) Division of application No. 09/967,163, filed on Sep. 28, 2001, now Pat. No. 6,585,030.

(30) Foreign Application Priority Data

Sep. 29, 2000 (AU) ..... PR0479

(51) Int. Cl.[7] ..... C22C 38/00; B22D 11/06

(52) U.S. Cl. ..... 148/320; 148/661; 148/654; 148/673; 164/455; 164/476; 164/477; 164/154.7; 164/154.3

(58) Field of Search ..... 164/455, 476, 164/477, 154.7, 154.3; 148/320, 661, 541, 673

(56) References Cited

U.S. PATENT DOCUMENTS

| | | | |
|---|---|---|---|
| 5,567,250 A | 10/1996 | Akamatsu et al. | 148/320 |
| 6,062,055 A | 5/2000 | Bobig et al. | 72/201 |
| 6,585,030 B2 * | 7/2003 | Strezov et al. | 164/455 |

FOREIGN PATENT DOCUMENTS

| | | |
|---|---|---|
| EP | 0 818 545 A1 | 1/1998 |
| GB | 2334464 | 8/1999 |
| JP | 61099630 | 5/1986 |
| JP | S61 1986-213322 | 9/1986 |
| JP | 62207828 | 9/1987 |
| JP | 63-62822 | 3/1988 |
| JP | H2 1990-236224 | 9/1990 |
| JP | 274321 | 12/1991 |
| JP | 4021723 | 1/1992 |
| JP | H4 1992-21723 | 1/1992 |
| WO | WO 9513155 A | 5/1995 |
| WO | WO 98/26882 | 6/1998 |
| WO | WO 9857767 A | 12/1998 |
| WO | WO 0121844 A | 3/2001 |

OTHER PUBLICATIONS

"Forming and cooling of direct cast steel strip", D Senk, F. Hagemann, B. Hammer, R. Kopp, H–P Schmitz and W. Schmitz Stahl und Elsen, vol. 120, No. 6 (Jun. 2000) original and translation.

* cited by examiner

*Primary Examiner*—Kiley Stoner
*Assistant Examiner*—I.-H. Lin
(74) *Attorney, Agent, or Firm*—Barnes & Thornburg

(57) ABSTRACT

Steel strips and methods for producing steel strips are provided. In an illustrated embodiment, a method includes continuously casting molten low carbon steel into a strip of no more than 5 mm thickness having austenite grains that are coarse grains of 100–300 micron width; and providing desired yield strength in the cast strip by cooling the strip to transform the austenite grains to ferrite in a temperature range between 850° C. and 400° C. at a selected cooling rate of at least 0.01° C./sec to produce a microstructure that provides a strip having a yield strength of at least 200 MPa. The low carbon steel produced desired microstructure.

12 Claims, 3 Drawing Sheets

3 (a)

3 (b)

3 (c)

3 (d)

METHOD OF PRODUCING STEEL STRIP

This application is a division of and co-owned U.S. application Ser. No. 09/967,163, the disclosure of which is hereby incorporated herein by reference, now U.S. Pat. No. 6,585,030, filed Sep. 28, 2001, which claims the benefit of Australian Patent Application No. PR0479, filed Sep. 29, 2000.

BACKGROUND AND SUMMARY OF THE INVENTION

The present invention relates to a method of producing steel strip and the cast steel strip produced according to the method.

In particular, the present invention relates to producing steel strip in a continuous strip caster.

The term "strip" as used in the specification is to be understood to mean a product of 5 mm thickness or less.

The applicant has carried out extensive research and development work in the field of casting steel strip in a continuous strip caster in the form of a twin roll caster.

In general terms, casting steel strip continuously in a twin roll caster involves introducing molten steel between a pair of contra-rotated horizontal casting rolls which are internally water cooled so that metal shells solidify on the moving rolls surfaces and are brought together at the nip between them to produce a solidified strip delivered downwardly from the nip between the rolls, the term "nip" being used to refer to the general region at which the rolls are closest together. The molten metal may be poured from a ladle into a smaller vessel from which it flows through a metal delivery nozzle located above the nip so as to direct it into the nip between the rolls, so forming a casting pool of molten metal supported on the casting surfaces of the rolls immediately above the nip and extending along the length of the nip. This casting pool is usually confined between side plates or dams held in sliding engagement with end surfaces of the rolls so as to dam the two ends of the casting pool against outflow, although alternative means such as electromagnetic barriers have also been proposed. The casting of steel strip in twin roll casters of this kind is for example described in U.S. Pat. Nos. 5,184,668, 5,277,243 and 5,934,359.

Steel strip is produced of a given composition that has a wide range of microstructures, and therefore a wide range of yield strengths, by continuously casting the strip and thereafter selectively cooling the strip to transform austenite to ferrite in a temperature range between 850° C. and 400° C. It is understood that the transformation range is within the range between 850° C. and 400° C. and not that entire temperature range. The precise transformation temperature range will vary with the chemistry of the steel composition and processing characteristics.

Specifically, from work carried out on low carbon steel, including low carbon steel that has been silicon/manganese killed or aluminum killed, it has been determined that selecting cooling rates in the range of 0.01° C./sec to greater than 100° C./sec to transform the strip from austenite to ferrite in a temperature range between 850° C. and 400° C., can produce steel strip that has yield strengths that range from 200 MPa to 700 MPa or greater. This is a significant development since, unlike conventional slab casting/hot rolling processes where chemistry changes are necessary to produce a broad range of properties, it has been determined that the same outcome can be achieved with a single chemistry.

Accordingly, there is provided a method of producing steel strip which comprises the steps of:

(a) continuously casting molten low carbon steel into a strip of no more than 5 mm thickness with coarse austenite grains of 100–300 micron width; and (b) cooling the strip to transform the austenite grains to ferrite in a temperature range between 850° C. and 400° C. at a selected cooling rate of at least 0.01° C./sec to produce a microstructure that provides a strip having a yield strength from between 200 MPa to in excess of 700 MPa, the microstructure selected from a group that includes microstructures that are:

(i) predominantly polygonal ferrite;

(ii) a mixture of polygonal ferrite and low temperature transformation products; and (iii) predominantly low temperature transformation products.

The term "low temperature transformation products" includes Widmanstatten ferrite, acicular ferrite, bainite and martensite.

The method may include passing the strip onto a run-out table and step (b) includes controlling cooling of the strip on the run-out table to achieve the selected cooling rate to transform the strip from austenite to ferrite in a temperature range between 850° C. and 400° C.

The method may include the additional step of in-line hot rolling the cast strip prior to cooling the strip to transform the austenite grains to ferrite in a temperature range between 850° C. and 400° C. This inline hot rolling step reduces the strip thickness up to 15%.

The cast strip produced in step (a) illustratively has a thickness of no more than 2 mm.

The coarse austenite grains produced in step (a) of 100–300 micron width have a length dependent on the thickness of the cast strip. Generally, the coarse austenite grains are up to slightly less than one-half the thickness of the strip. For example, for cast strip of 2 mm thickness, the coarse austenite grains will be up to about 750 microns in length.

The cast strip produced in step (a) may have austenite grains that are columnar.

The upper limit of the cooling rate in step (b) is at least 100° C./sec.

The term "low carbon steel" is understood to be mean steel of the following composition, in weight percent:

C: 0.02–0.08

Si: 0.5 or less;

Mn: 1.0 or less;

residual/incidental impurities: 1.0 or less; and

Fe: balance

The term "residual/incidental impurities" covers levels of elements, such as copper, tin, zinc, nickel, chromium, and molybdenum, that may be present in relatively small amounts, not as a consequence of specific additions of these elements but as a consequence of standard steel making. By way of example, the elements may be present as a result of using scrap steel to produce low carbon steel.

The low carbon steel may be silicon/manganese killed and may have the following composition by weight:

| | |
|---|---|
| Carbon | 0.02–0.08% |
| Manganese | 0.30–0.80% |
| Silicon | 0.10–0.40% |
| Sulphur | 0.002–0.05% |
| Aluminium | less than 0.01% |

The low carbon steel may be calcium treated aluminum killed and may have the following composition by weight:

| | |
|---|---|
| Carbon | 0.02–0.08% |
| Manganese | 0.40% max |
| Silicon | 0.05% max |
| Sulphur | 0.002–0.05% |
| Aluminum | 0.05% max |

The aluminum killed steel may be calcium treated.

The yield strength of aluminum killed steel is generally 20 to 50 MPa lower than that of silicon/manganese killed steel.

Illustratively, the cooling rate in step (b) is less than 1° C./sec to produce a microstructure that is predominantly polygonal ferrite and has a yield strength less than 250 MPa.

Illustratively, the cooling rate in step (b) is in the range of 1–15° C./sec to produce a microstructure that is a mixture of polygonal ferrite, Widmanstatten ferrite and acicular ferrite and has a yield strength in the range of 250–300 MPa.

Illustratively, the cooling rate in step (b) is in the range of 15–100° C./sec to produce a microstructure that is a mixture of polygonal ferrite, bainite and martensite and has a yield strength in the range of 300–450 MPa.

Illustratively, the cooling rate in step (b) is at least 100° C./sec to produce a microstructure that is a mixture of polygonal ferrite, bainite and martensite and has a yield strength at least 450 MPa.

The continuous caster may be a twin roll caster.

There is provided a low carbon steel produced by the method described above having desired microstructure and yield strength.

BRIEF DESCRIPTION OF THE DRAWINGS

In order that the invention may be more fully explained, an example will be described with reference to the accompanying drawings, of which.

DETAILED DESCRIPTION OF THE INVENTION

The following description of the described embodiments is in the context of continuous casting steel strip using a twin roll caster. The present invention is not limited to the use of twin roll casters and extends to other types of continuous strip casters.

Figure 1:
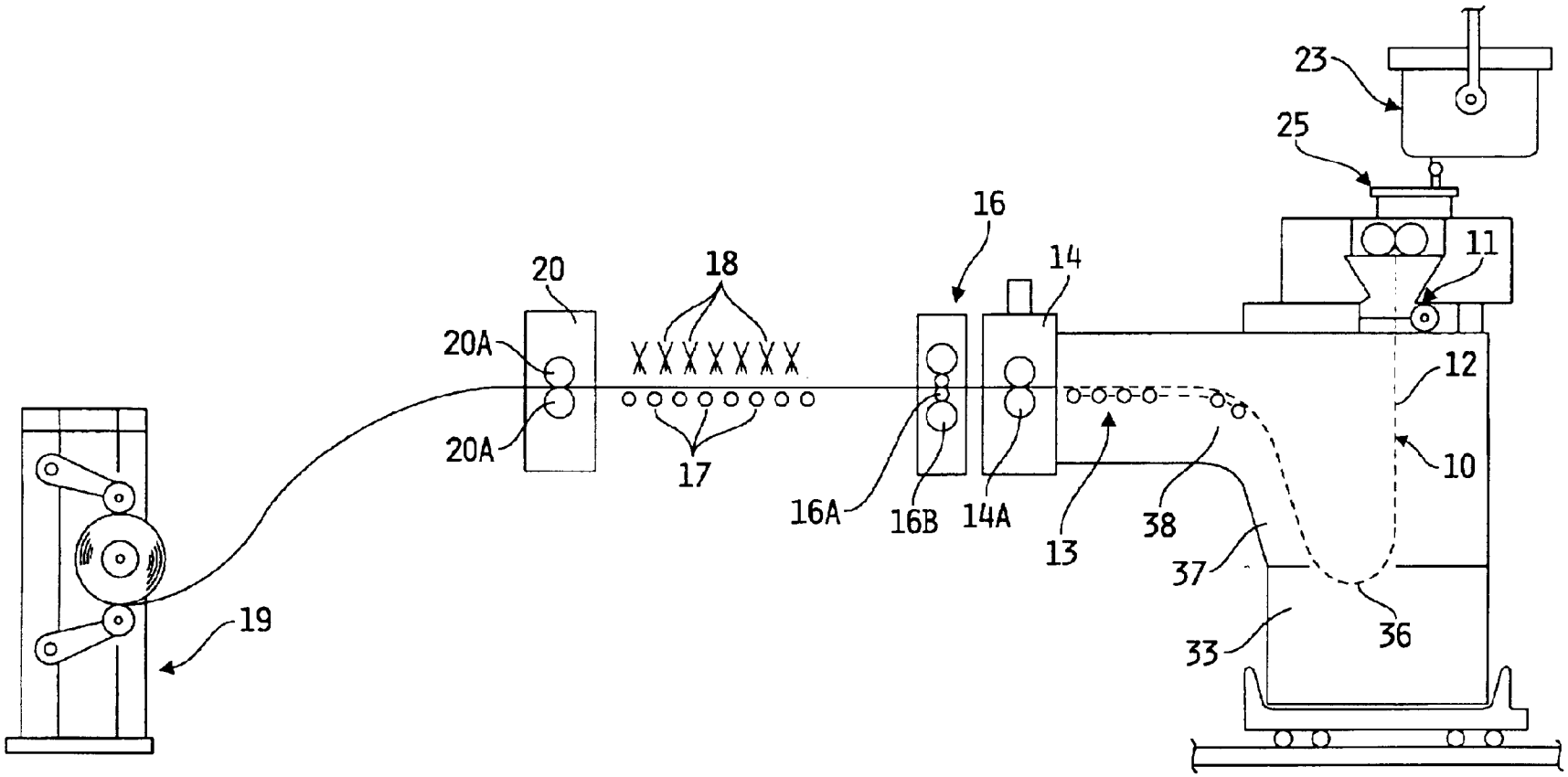
FIG. 1 illustrates a strip casting installation incorporating an in-line hot rolling mill and coiler.
Figure 2:
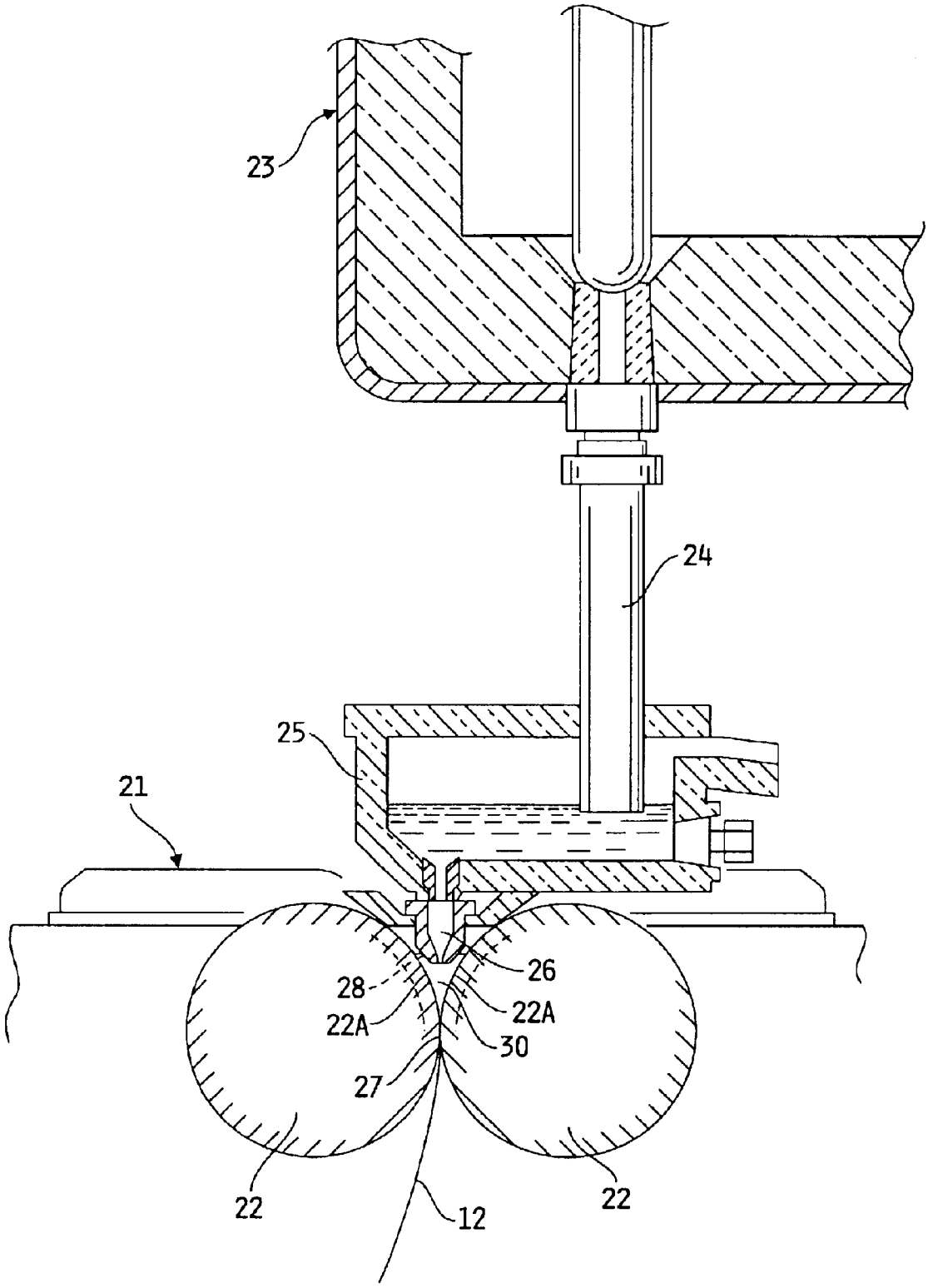
FIG. 2 illustrates details of the twin roll strip caster.

FIG. 1 illustrates successive parts of a production line whereby steel strip can be produced in accordance with the present invention. FIGS. 1 and 2 illustrate a twin roll caster denoted generally as 11 which produces a cast steel strip 12 that passes in a transit path 10 across a guide table 13 to a pinch roll stand 14 comprising pinch rolls 14A. Immediately after exiting the pinch roll stand 14, the strip passes into a hot rolling mill 16 comprising a pair of reduction rolls 16A and backing rolls 16B by in which it is hot rolled to reduce its thickness. The rolled strip passes onto a run-out table 17 on which it may be cooled by convection by contact with water supplied via water jets 18 (or other suitable means) and by radiation. The rolled strip then passes through a pinch roll stand 20 comprising a pair of pinch rolls 20A and thence to a coiler 19. Final cooling (if necessary) of the strip takes place on the coiler.

As shown in FIG. 2, twin roll caster 11 comprises a main machine frame 21 which supports a pair of parallel casting rolls 22 having a casting surfaces 22A. Molten metal is supplied during a casting operation from a ladle (not shown) to a tundish 23, through a refractory shroud 24 to a distributor 25 and thence through a metal delivery nozzle 26 into the nip 27 between the casting rolls 22. Molten metal thus delivered to the nip 27 forms a pool 30 above the nip and this pool is confined at the ends of the rolls by a pair of side closure dams or plates 28 which are applied to the ends of the rolls by a pair of thrusters (not shown) comprising hydraulic cylinder units connected to the side plate holders. The upper surface of pool 30 (generally referred to as the "meniscus" level) may rise above the lower end of the delivery nozzle so that the lower end of the delivery nozzle is immersed within this pool.

Casting rolls 22 are water cooled so that shells solidify on the moving roll surfaces and are brought together at the nip 27 between them to produce the solidified strip 12 which is delivered downwardly from the nip between the rolls.

The twin roll caster may be of the kind which is illustrated and described in some detail in U.S. Pat. Nos. 5,184,668 and 5,277,243 or U.S. Pat. No. 5,488,988 and reference may be made to those patents for appropriate constructional details which form no part of the present invention.

The above-described twin roll caster continuously casts strip 12 of no more than 2 mm thickness with a microstructure of columnar austenite grains of 100–300 micron width.

In accordance with the illustrated embodiment of the method described, the cooling rate of the cast strip to transform the austenite grains to ferrite in a temperature range between 850° C. and 400° C. is selected to control transformation of austenite into a ferrite microstructure that is required to provide specified yield strength of the cast strip.

In accordance with the illustrated embodiment, the cooling rate is at least 0.01° C./sec and may be in excess of 100° C./sec and is selected to transform the austenite grains to ferrite until austenite transformation is completed.

In the case of low carbon steels, such a range of microstructures can produce yield strengths in the range of 200 MPa to in excess of 700 MPa.

With such cooling rates for low carbon steel it is possible to produce cast strip having microstructures including:

(i) predominantly polygonal ferrite;
(ii) a mixture of polygonal ferrite and low temperature transformation products, such as a Widmanstatten ferrite, acicular ferrite, and bainite; and
(iii) predominantly low temperature transformation products.

In the case of low carbon steels, such a range of microstructures can produce yield strengths in the range of 200 MPa to in excess of 700 MPa.

The present disclosure is based in part on experimental work carried out on silicon/manganese killed low carbon steel.

The table set out below summarises the effect of cooling rate to transform the strip from austenite to ferrite in a temperature range between 850° C. and 400° C. on the microstructure and resultant yield strength of silicon/manganese killed low carbon steel strip. The strips were cast in a twin roll caster of the type described above.

| Cooling Rate (° C./sec) | Microstructure Constituents | Yield Strength (Mpa) |
|---|---|---|
| 0.1 | Polygonal ferrite, Pearlite | 210 |
| 13 | Polygonal ferrite, Widmanstatten ferrite, acicular ferrite | 320 |
| 25 | Polygonal ferrite, Bainite | 390 |
| 100 | Polygonal ferrite, Bainite, Martensite | 490 |

Figure 3:
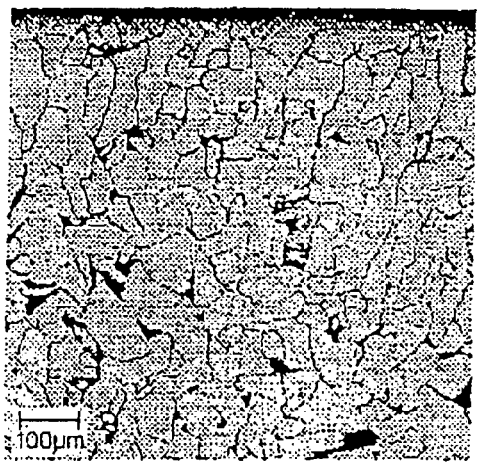
FIGS. 3(*a*) to 3(*d*) are photomicrographs of cast strip that illustrate the effect on final microstructure of cooling rates during the austenite to ferrite transformation in the temperature range.
Figure 3:
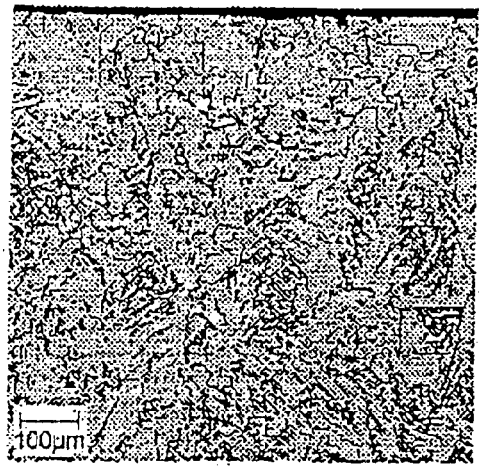
Figure 3:
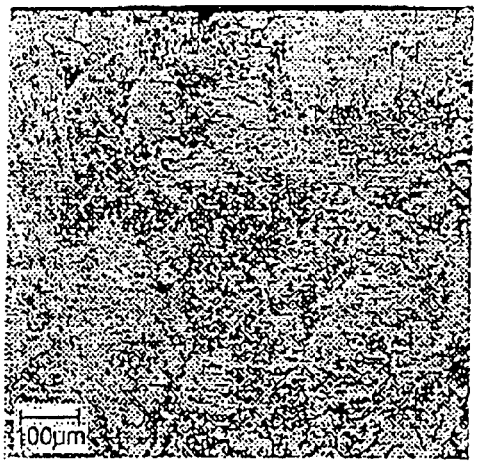
Figure 3:
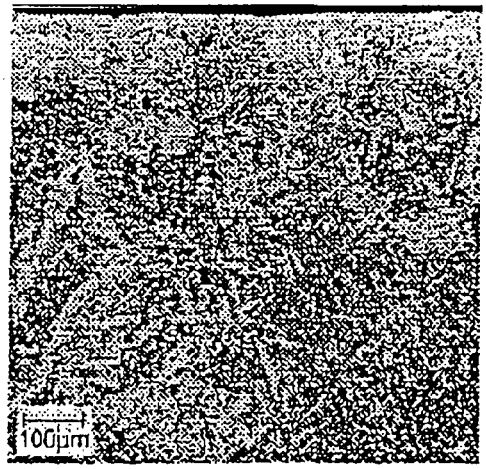

FIGS. 3(*a*) to 3(*d*) are photomicrographs of the final microstructure of the cast strip.

It is clear from the table and the photomicrographs that selection and control of the cooling rate had a significant impact on the microstructure and yield strength of the single chemistry cast strip. As noted above, in conventional slab casting/hot rolling processes, a range of different chemistries would be required to achieve the range of yield strength. The range of chemistries was in the past achieved by adding differing amounts of alloys that add considerable cost to the steel production process.

Control of the cooling rate to transform the austenite grains to ferrite in a temperature range between 850° C. and 400° C. is achieved by controlling cooling on the run-out table 17 and/or the coiler 19 of the strip casting installation.

The production of soft materials (yield strength<350 MPa) requires relatively slow cooling rates through the austenite to ferrite transformation temperature range. In order to achieve the slow cooling rates, it is necessary to complete austenite transformation on the coiler 19.

The production of harder materials (yield strength>400 MPa) requires higher cooling rates to transform the strip from austenite to ferrite in a temperature range between 850° C. and 400° C. In order to achieve the higher cooling rates the austenite transformation is completed on the run-out table.

FIGS. 3(*a*) to 3(*d*) are photomicrographs of the final microstructures of the cast strip.

Although the invention has been illustrated and described in detail in the foregoing drawings and description with reference to several embodiments, it should be understood that the description is illustrative and not restrictive in character, and that the invention is not limited to the disclosed embodiments. Rather, the present invention covers all variations, modifications and equivalent structures that come within the scope and spirit of the invention. Additional features of the invention will become apparent to those skilled in the art upon consideration of the detailed description, which exemplifies the best mode of carrying out the invention as presently perceived. Many modifications may be made to the present invention as described above without departing from the spirit and scope of the invention.

What is claimed is:

1. A low carbon steel produced by a process comprising the steps of:

(a) continuously casting molten low carbon steel into a strip of no more than 5 mm thickness with austenite grains that are coarse grains of 100–300 micron width; and (b) providing desired mechanical properties in the cast strip without changing the chemistry requirements of the steel supplied by cooling the strip to transform the austenite grains to ferrite in a temperature range from 850° C. to 400° C. at a selected cooling rate of at least 0.01° C./sec to produce a microstructure that provides a strip having a yield strength between 200 and in excess of 700 MPa, the microstructure being selected from the group consisting of:

(i) predominantly polygonal ferrite;

(ii) a mixture of polygonal ferrite and low temperature transformation products; and (iii) predominantly low temperature transformation products.

2. The low carbon steel as described in claim 1 wherein the cast strip produced in step (a) has a thickness of no more than 2 mm.

3. The low carbon steel as described in claim 1 wherein the austenite grains produced in step (a) are columnar.

4. The low carbon steel as described in claim 1 wherein the cooling rate in step (b) is at least 100° C./sec.

5. The low carbon steel as described in claim 1 wherein the low carbon steel is silicon/manganese killed.

6. The low carbon steel as described in claim 5 wherein the low carbon steel has the following composition by weight:

| | |
|---|---|
| Carbon | 0.02–0.08% |
| Manganese | 0.30–0.80% |
| Silicon | 0.10–0.40% |
| Sulphur | 0.002–0.05% |
| Aluminum | less than 0.01%. |

7. The low carbon steel as described in claim 1 wherein the low carbon steel is aluminum killed.

8. The low carbon steel as described in claim 7 wherein the low carbon steel has the following composition by weight:

| | |
|---|---|
| Carbon | 0.02–0.08% |
| Manganese | 0.40% max |
| Silicon | 0.05% max |
| Sulphur | 0.002–0.05% |
| Aluminum | 0.05% max. |

9. The low carbon steel as described in claim 1 wherein the cooling rate in step (b) is less than 1° C./sec in order to produce a microstructure that is predominantly polygonal ferrite and has a yield strength between 200 and 250 MPa.

10. The low carbon steel as described in claim 1 wherein the cooling rate in step (b) is in the range of 1–15° C./sec in order to produce a microstructure that is a mixture of polygonal ferrite, Widmanstatten ferrite and acicular ferrite and has a yield strength in the range of 250–300 MPa.

11. The low carbon steel as described in claim 1 wherein the cooling rate in step (b) is in the range of 15–100° C./sec in order to produce a microstructure that is a mixture of polygonal ferrite and bainite and has a yield strength in the range of 300–450 MPa.

12. The low carbon steel as described in claim 1 wherein the cooling rate in step (b) is at least 100° C./sec in order to produce a microstructure that is a mixture of polygonal ferrite, bainite and martensite and has a yield strength of at least 450 MPa.

* * * * *